US012421584B2

(12) United States Patent
Ohno et al.

(10) Patent No.: US 12,421,584 B2
(45) Date of Patent: Sep. 23, 2025

(54) LOW THERMAL EXPANSION CAST STEEL AND METHOD OF PRODUCING SAME

(71) Applicant: SHINHOKOKU MATERIAL CORP., Kawagoe (JP)

(72) Inventors: Haruyasu Ohno, Kawagoe (JP); Naoki Sakaguchi, Kawagoe (JP); Kotaro Ona, Kawagoe (JP)

(73) Assignee: SHINHOKOKU MATERIAL CORP., Kawagoe (JP)

( * ) Notice: Subject to any disclaimer, the term of this patent is extended or adjusted under 35 U.S.C. 154(b) by 498 days.

(21) Appl. No.: 17/908,550

(22) PCT Filed: Jul. 12, 2021

(86) PCT No.: PCT/JP2021/026189
§ 371 (c)(1),
(2) Date: Sep. 1, 2022

(87) PCT Pub. No.: WO2022/014544
PCT Pub. Date: Jan. 20, 2022

(65) Prior Publication Data

US 2023/0148368 A1 May 11, 2023

(30) Foreign Application Priority Data

Jul. 17, 2020 (JP) ..... 2020-122884

(51) Int. Cl.

| | |
|---|---|
| ***C22C 38/10*** | (2006.01) |
| ***C21D 1/78*** | (2006.01) |
| ***C21D 6/04*** | (2006.01) |
| ***C22C 38/02*** | (2006.01) |
| ***C22C 38/04*** | (2006.01) |

(52) U.S. Cl.
CPC ..... *C22C 38/105* (2013.01); *C21D 1/785* (2013.01); *C21D 6/04* (2013.01); *C22C 38/02* (2013.01); *C22C 38/04* (2013.01)

(58) Field of Classification Search
CPC ..... C22C 38/105; C22C 38/02; C22C 38/04; C22C 38/004; C21D 1/785; C21D 6/04; C21D 2211/001; C21D 1/18; C21D 1/78; C21D 6/001; C21D 1/26
See application file for complete search history.

(56) References Cited

FOREIGN PATENT DOCUMENTS

| | | | | | |
|---|---|---|---|---|---|
| CN | 105296844 | A | | 2/2016 | |
| EP | 4 130 299 | A1 | | 2/2023 | |
| JP | 6-172919 | A | | 6/1994 | |
| JP | 11-279709 | A | | 10/1999 | |
| JP | 11-293413 | A | | 10/1999 | |
| JP | 2015-168865 | A | | 9/2015 | |
| JP | 2016-27187 | A | | 2/2016 | |
| JP | 2016027187 | A | * | 2/2016 | ..... C21D 6/001 |
| JP | 2018-188690 | A | | 11/2018 | |
| JP | 2020-122180 | A | | 8/2020 | |
| JP | 2020-122188 | A | | 8/2020 | |
| WO | WO 2015/136766 | A1 | | 9/2015 | |

* cited by examiner

*Primary Examiner* — Michael E Barr
(74) *Attorney, Agent, or Firm* — Birch, Stewart, Kolasch & Birch, LLP

(57) ABSTRACT

A low thermal expansion cast steel having a sufficient strength even at a high temperature and having a low coefficient of thermal expansion, that is, a low thermal expansion cast steel comprising, by mass %, C: 0 to 0.100%, Si: 0 to 1.00%, Mn: 0 to 1.00%, Co: 8.0 to 13.0%, and Ni satisfying $-2.5\times\%\ Ni+85.5\leq\%\ Co\leq-2.5\times\%\ Ni+90.5$ (% Ni and % Co respectively being contents of Ni and Co (mass %)) and having a balance of Fe and unavoidable impurities and having, upon being subjected to suitable heat treatment, a 0.2% proof stress of a tensile test at 300° C. of 125 MPa or more, having an average coefficient of thermal expansion at 25 to 300° C. of 4.0 ppm/° C. or less, and having a Curie temperature of 250° C. or more.

4 Claims, No Drawings

LOW THERMAL EXPANSION CAST STEEL AND METHOD OF PRODUCING SAME

FIELD

The present invention relates to a low thermal expansion cast steel, more particularly relates to a low thermal expansion cast steel excellent in high temperature strength.

BACKGROUND

Along with the advances in communications technology in recent years, the parabolic antennas and the like used for transmission and reception facilities have become extremely large in size. Low thermal expansion of course and also working precision, that is, high castability, machineability, vibration absorbing ability, mechanical strength, etc. have become sought. For example, carbon fiber reinforced plastic (CFRP) with its high rigidity and corrosion resistance is now being generally used as antenna reflectors.

The coefficient of thermal expansion of CFRP is smaller than steel. To secure a high dimensional precision even after shaping, the shaping mold has to be made of a material having the same extent of a coefficient of thermal expansion. For this reason, an Invar alloy or a Super Invar alloy is selected as the material for the shaping mold.

PTL 1 discloses using as a shaping mold a low coefficient of thermal expansion cast iron having a graphite structure in an austenite base iron in which the cast iron is comprised of, as the chemical composition expressed by weight %, solid solution carbon in 0.09% or more and 0.43% or less, silicon in less than 1.0%, nickel in 29% or more and 34% or less, and cobalt in 4% or more and 8% or less and a balance of iron and has a coefficient of thermal expansion in a 0 to 200° C. temperature range of $4\times10^{-6}$ PC or less.

PTL 2 discloses using as a member of ultra precision equipment including a CFRP mold an alloy steel excellent in thermal dimensional stability and rigidity having a chemical composition containing C: 0.1 wt % or less, Si: 0.1 to 0.4 wt %, Mn: 0.15 to 0.4 wt %, Ti: more than 2 to 4 wt %, Al: 1 wt % or less, Ni: 30.7 to 43.0 wt %, and Co: 14 wt % or less, having contents of Ni and Co satisfying the following formula (1), and having a balance of Fe and unavoidable impurities, and, further, having a coefficient of thermal expansion at −40 to 100° C. in temperature range of $4\times10^{-6}$/° C. or less and a Young's modulus of 16100 kgf/mm$^2$ or more.

$$37.7\leq Ni+0.8\times Co\leq 43 \quad (1)$$

CITATION LIST

Patent Literature

[PTL 1] Japanese Unexamined Patent Publication No. 6-172919

[PTL 2] Japanese Unexamined Patent Publication No. 11-293413

SUMMARY

Technical Problem

The Invar alloy and Super Invar alloy used for conventional CFRP shaping molds have as the technical problem to be solved the low strength at the high temperature of the region of usage temperature of the mold and therefore the susceptibility of the mold to damage.

The present invention, in consideration of the above situation, has as its technical problem to provide a low thermal expansion cast steel having sufficient strength even at 300° C. of the region of usage temperature of a CFRP mold and having a low coefficient of thermal expansion at 25 to 300° C. in range.

Solution to Problem

The inventors intensively studied the method for raising the high temperature proof stress of a low thermal expansion cast steel. As a result, they discovered that by controlling the contents of Ni and Co in a Fe—Ni—Co alloy to suitable ranges and further applying suitable heat treatment after casting, it is possible to raise the high temperature proof stress without using Nb, Ti, Al, and other expensive alloy elements.

The present invention was made based on the above discovery and has as its gist the following:

(1) A low thermal expansion cast steel having a chemical composition containing, by mass %, C: 0 to 0.100%, Si: 0 to 1.00%, Mn: 0 to 1.00%, Co: 8.0 to 13.0%, and Ni satisfying $-2.5\times\%\ Ni+85.5\leq\%\ Co\leq-2.5\times\%\ Ni+90.5$ (% Ni and % Co respectively meaning contents of Ni and Co (mass %)) and having a balance of Fe and unavoidable impurities, having a 0.2% proof stress at a tensile test at 300° C. of 125 MPa or more, having an average coefficient of thermal expansion at 25 to 300° C. of 4.0 ppm/° C. or less, and having a Curie temperature of 250° C. or more.

(2) A method for producing a low thermal expansion cast steel successively comprising a cryogenic treatment step for cooling a cast steel having a chemical composition of the above (1) from room temperature to an Ms point or less, holding the cast steel at a temperature of the Ms point or less for 0.5 to 3 hr, and raising the temperature up to room temperature and a recrystallization treatment step for heating the cast steel to 800 to 1200° C., holding the cast steel there for 0.5 to 5 hr, then quenching.

(3) A method for producing a low thermal expansion cast steel successively comprising a first cryogenic treatment step for cooling a cast steel having a chemical composition of the above (1) from room temperature to an Ms point or less, holding the cast steel at a temperature of the Ms point or less for 0.5 to 3 hr, and raising the temperature up to room temperature, a recrystallization treatment step for heating the cast steel to 800 to 1200° C., holding the cast steel there for 0.5 to 5 hr, then quenching, a second cryogenic treatment step for cooling the cast steel from room temperature to the Ms point or less, holding the cast steel at a temperature of the Ms point or less for 0.5 to 3 hr, and raising the temperature up to room temperature, and a reverse transformation treatment step for heating the cast steel to 550 to 750° C., holding the cast steel there for 0.5 to 5 hr, then quenching.

(4) A method for producing a low thermal expansion cast steel successively comprising a cryogenic treatment step for cooling a cast steel having a chemical composition of the above (1) from room temperature to an Ms point or less, holding the cast steel at a temperature of the Ms point or less for 0.5 to 3 hr, and raising the temperature up to room temperature and a reverse transformation treatment step for heating the cast steel to 550 to 750° C., holding the cast steel there for 0.5 to 5 hr, then quenching.

Advantageous Effect of Invention

According to the present invention, a low thermal expansion cast steel having a high proof stress in the high temperature region and further having a low coefficient of thermal expansion is obtained, so can be used for a member of ultra precision equipment such as a CFRP mold used at a high temperature.

DESCRIPTION OF EMBODIMENTS

Below, the present invention will be explained in detail. Below, the "%" relating to the chemical composition will mean "mass %" unless otherwise indicated. First, the chemical composition of the cast steel of the present invention will be explained.

In the present invention, Ni and Co are essential elements contributing to reduction of the coefficient of thermal expansion by addition in combination. In particular, in the present invention, to make the Curie temperature 250° C. or more, Co is made to be included in a certain amount or more. Further, to make the coefficient of thermal expansion sufficiently small in a broad temperature range, a suitable amount of Ni is made to be included according to the amount of Co. If the amounts of Ni and Co are too large, the Ms point becomes too low and it becomes difficult to cause martensite transformation by the later explained cooling, so the ranges of the amount of Ni and the amount of Co are determined considering this as well.

To make the Curie temperature 250° C. or more and further to make the coefficient of thermal expansion sufficiently small in a broad temperature range, the content of Co is made 8.0 to 13.0% and the content of Ni is made a range satisfying $-2.5\times\%\ Ni+85.5\leq\%\ Co\leq-2.5\times\%\ Ni+90.5$ when defining the content of Co as % Co (mass %) and the content of Ni as % Ni (mass %). The upper limit of the amount of Co is preferably 12.0%, more preferably 11.0%. The content of Ni may preferably satisfy $-2.5\times\%\ Ni+86.5\leq\%\ Co\leq-2.5\times\%\ Ni+89.5$, more preferably $-2.5\times\%\ Ni+87.0\leq\%\ Co\leq-2.5\times\%\ Ni+89.0$.

The Curie temperature is made 250° C. or more so as to obtain a low coefficient of thermal expansion even at a high temperature. There is a close relationship between the Curie temperature and the coefficient of thermal expansion. In an Invar alloy, at the Curie temperature or less, the coefficient of thermal expansion becomes close to 0, but if more than the Curie temperature, the coefficient of thermal expansion rapidly increases. The low thermal expansion cast steel of the present invention envisions use near 300° C. of the region of usage temperature of a CFRP mold. To make the coefficient of thermal expansion in this temperature range a low value, the Curie temperature is made 250° C. or more. A Curie temperature of 280° C. or more is preferable, 300° C. or more is more preferable, 310° C. or more is still more preferable.

C dissolves in austenite and contributes to a rise in strength, so may be included in accordance with need. This effect is obtained even with a small amount, but it is effective and preferable if the amount of C is made 0.010% or more. If the content of C becomes great, the coefficient of thermal expansion becomes larger and further the ductility falls and casting cracks easily form, so the content is made 0.100% or less, preferably 0.050% or less, more preferably 0.020% or less. In the low thermal expansion cast steel of the present invention, C is not an essential element. The content may also be 0.

Si may be added as a deoxidizer. Further, it can improve the fluidity of the melt. This effect is obtained even with a small amount, but it is effective and preferable if the amount of Si is made 0.05% or more. If the content of Si becomes more than 1.00%, the coefficient of thermal expansion increases, so the amount of Si is made 1.00% or less, preferably 0.50% or less, more preferably 0.20% or less. In the low thermal expansion cast steel of the present invention, Si is not an essential element. The content may also be 0.

Mn may be added as a deoxidizer. Further, it contributes to improvement of the strength by solution strengthening. This effect is obtained even with a small amount, but it is effective and preferable if the amount of Mn is made 0.10% or more. If the content of Mn becomes more than 1.00%, the effect becomes saturated and the cost rises, so the amount of Mn is made 1.00% or less, preferably 0.80% or less, more preferably 0.60% or less, still more preferably 0.50% or less. In the low thermal expansion cast steel of the present invention, Mn is not an essential element. The content may also be 0.

The balance of the chemical composition consists of Fe and unavoidable impurities. The "unavoidable impurities" mean elements unavoidably entering from the raw materials or manufacturing environment etc. when industrially producing steel having the chemical composition prescribed in the present invention. Specifically, 0.02% or less of P, S, O, N, etc. may be mentioned.

Next, the method of producing the low thermal expansion cast steel of the present invention will be explained.

First, a cast steel having the desired chemical composition is produced by a casting operation. The casting mold used for the casting operation and the apparatus and method for injection of the molten steel into the casting mold are not particularly limited. A known apparatus and method may be used.

The obtained cast steel is subjected any of the following heat treatments:

[1] first cryogenic treatment step→recrystallization treatment step

[2] first cryogenic treatment step→recrystallization treatment step→second cryogenic treatment step→reverse transformation treatment step

[3] first cryogenic treatment step→reverse transformation treatment step

These respective processes will be explained.

First Cryogenic Treatment Step

The cast steel is cooled down to the Ms point or less, is held at the Ms point or less temperature for 0.5 to 3 hr, then is raised up to room temperature. The method of cooling is not particularly limited. Note that, the "Ms point" referred to here is the Ms point at the stage before the effect of the present invention is manifested. The cooling temperature need only be made a temperature sufficiently lower than the Ms point, so there is no need to learn the exact Ms point at this stage. In general, the Ms point can be estimated by the following formula using the constituents of the steel.

$$Ms=521-353C-22Si-24.3Mn-7.7Cu-17.3Ni-17.7Cr-25.8Mo$$

Here, "C", "Si", "Mn", "Cu", "Ni", "Cr", and "Mo" are the contents of the respective elements (mass %). For elements not contained, 0 is used.

In the case of the chemical composition of the low thermal expansion cast steel of the present invention, the Ms point calculated by the above formula is particularly dependent on the amount of Ni and becomes from room temperature to −100° C. or less or so, therefore as the cooling medium, down to −80° C., dry ice or methyl alcohol or ethyl alcohol can be used. Further, down to the further lower temperature of −196° C., the method of immersion in liquid nitrogen or the method of spraying liquid nitrogen can be used. Due to this, a structure containing martensite is formed. Further, the temperature may be raised by lifting out the cast steel into a room temperature atmosphere.

Recrystallization Treatment Step

The cast steel is reheated up to 800 to 1200° C., held at 800 to 1200° C. for 0.5 to 5 hr, and rapidly cooled down to room temperature. Due to this, the structure in which martensite is formed returns to an austenite structure. The particle size of the structure formed by usual solidification is 1 to 10 mm or so, but by going through the above cryogenic treatment step and later recrystallization treatment step, the austenite size becomes finer and the structure becomes one of mostly equiaxial crystals with random crystal orientations. The structure after quenching becomes a structure of fine equiaxial crystals of an average size of 30 to 800 μm or so. Due to this, the Young's modulus can be raised. Further, a high 0.2% proof stress at 300° C. can be obtained. The method of quenching is not particularly limited, but water cooling is preferable.

Second Cryogenic Treatment Step

After the recrystallization treatment, the cast steel is again cooled down to the Ms point or less, is held at the Ms point or less temperature for 0.5 to 3 hr, then is raised up to room temperature. The cooling and temperature rise of the second cryogenic treatment step may be performed in the same way as the first cryogenic treatment step. Due to this treatment, the structure of the cast steel again becomes a structure including martensite.

Reverse Transformation Treatment Step

After the cryogenic treatment, the cast steel is heated to 550 to 750° C., held there for 0.5 to 5 hr, then rapidly cooled down to room temperature to thereby render the structure austenite. When the structure transforms to martensite by the cryogenic treatment step, plastic deformation occurs. The strain (dislocation) at that time remains in the structure rendered austenite by the reverse transformation treatment. Due to this, it is possible to obtain a higher 0.2% proof stress at 300° C.

A martensite structure returns to austenite by heating to 550° C. or more, but if the heating temperature is more than 750° C., the austenite recrystallizes driven by the dislocations, so the heating temperature is made 750° C. or less. Note that, the size of the austenite crystal grains does not change due to the cryogenic treatment step and the following reverse transformation treatment step.

As explained above, a high Young's modulus and high 0.2% proof stress at 300° C. can be obtained by the cryogenic treatment step→recrystallization treatment step, while a high 0.2% proof stress at 300° C. can be obtained by the cryogenic treatment step→reverse transformation treatment step, so the processes of the above [1] to [3] may be selected in accordance with the required characteristics.

After the first cryogenic treatment step and the second cryogenic treatment step, a thermal refining treatment process for heating the cast steel to 300 to 500° C. and holding it there for 2 to 6 hr may be provided. The thermal refining treatment process may be provided only after one of the first cryogenic treatment step and the second cryogenic treatment step or may be provided after both processes. Due to the thermal refining, the temperature of the later recrystallization and reverse transformation sometimes falls and the treatment sometimes can be made more efficient.

Before the first cryogenic treatment step, a solution treatment process for heating the cast steel to 800 to 1200° C., holding it there for 0.5 to 5 hr, and rapidly cooling it down to room temperature may be provided. Due to the solubilization, the precipitates formed at the time of casting dissolve into a solid solution and the ductility and toughness are improved. The method of quenching is not particularly limited, but water cooling is preferable.

When producing a cast steel, it is also possible to include in the melt an inoculant such as Nb, Ti, B, Mg, Ce, or La so as to make the solidification nuclei more easily form. Further, it is also possible to coat the surface of the casting mold with $Co(AlO_2)$, $CoSiO_3$, Co-borate, or other such inoculant together with the mold coating material usually coated on a casting mold so as to make the solidification nuclei more easily form. Furthermore, the melt in the casting mold may be stirred and made to flow by the method of using an electromagnetic stirring device, the method of mechanically making the casting mold shake, the method of making the melt shake by ultrasonic waves, etc. By applying these methods, the structure of the casting more easily becomes equiaxial crystals, so the low thermal expansion cast steel of the present invention can be produced more efficiently.

The excellent high temperature strength of the low thermal expansion cast steel of the present invention can be evaluated by the results of a tensile test at 300° C. Specifically, the low thermal expansion cast steel of the present invention has the characteristic of a 0.2% proof stress measured by a tensile test at 300° C. of 125 MPa or more, preferably 130 MPa or more, more preferably 140 MPa or more, still more preferably 150 MPa or more.

The low thermal expansion cast steel of the present invention can further be given an average coefficient of thermal expansion at 25 to 300° C. of 4.0 ppm/° C. or less, preferably 3.5 ppm/° C. or less, more preferably 3.0 ppm/° C. or less, i.e., a low coefficient of thermal expansion at a wide temperature range. If adjusting the constituents so that the average coefficient of thermal expansion becomes 2.0 to 4.0 ppm, this is compatible with the coefficient of thermal expansion of CFRP, so the cast steel is suitable as a member of a mold for shaping CFRP.

The low thermal expansion cast steel of the present invention has a high Curie temperature, so has a high level high temperature proof stress without any large increase in the coefficient of thermal expansion even at a high temperature, so can keep down damage even when used for a CFRP mold or other member of ultraprecision equipment used at a high temperature.

EXAMPLES

A melt prepared using a high frequency melting furnace so as to give each chemical composition shown in Table 1 was poured into a casting mold to produce a Y block. After that, it was subjected to the heat treatment shown below:

Treatment No. 1:

First cryogenic treatment step→recrystallization treatment step

Treatment No. 2:

First cryogenic treatment step→recrystallization treatment step→second cryogenic treatment step→reverse transformation treatment step Treatment No. 3:

First cryogenic treatment step→reverse transformation treatment step

Treatment No. 0:

No heat treatment

In the first cryogenic treatment step, the Y block was immersed in liquid nitrogen to cool it to the Ms point or less, then was held there for 1.5 hr, after that was taken out from the liquid nitrogen and allowed to stand at room temperature until rising to room temperature.

In the recrystallization treatment step, the Y block was heated to the temperature described in Table 1, was held there for 3 hr, then was water cooled.

In the second cryogenic treatment step, similar treatment to the first cryogenic treatment step was performed.

In the reverse transformation treatment step, the Y block was heated to the temperature described in Table 1, was held there for 3 hr, then was water cooled.

Two samples were taken from the obtained cast steel. 300° C. tensile tests (based on JIS G 0567) were conducted, the 0.2% proof stress were measured by the offset method, and the average of the two was used as the measurement value. Similarly, a test piece for measurement of the coefficient of thermal expansion was taken and the 25 to 300° C. average coefficient of thermal expansion and Curie temperature were measured. For the Curie temperature, the inflection point found from the chart of elongation-temperature at the time of measurement was used.

The results are shown in Table 1.

The low thermal expansion cast steels of the present invention exhibited low coefficient of thermal expansions and high 0.2% proof stress at the 300° C. tensile tests.

As opposed to this, in the comparative examples, the targeted characteristics failed to be obtained in at least one of the 300° C. 0.2% proof stress and coefficient of thermal expansion.

TABLE 1

| | Alloy | Chemical constituents (mass %), balance of Fe and unavoidable impurities | | | | | Treatment | Heat treatment | | | | | Coefficient | |
|---|---|---|---|---|---|---|---|---|---|---|---|---|---|---|
| | | | | | | | | 1st | Recrystal-lization | 2nd | Reverse trans-formation | Curie temp. | of thermal expansion α25-300° C. | 0.2% proof stress |
| | no. | C | Si | Mn | Ni | Co | no. | cryo | (° C.) | cryo | (° C.) | (° C.) | (ppm/° C.) | (MPa) |
| Inv. Ex. 1 | 1 | 0.014 | 0.11 | 0.51 | 31.2 | 9.1 | 1 | Yes | 830 | — | — | 330 | 2.3 | 131 |
| Inv. Ex. 2 | 1 | 0.014 | 0.11 | 0.51 | 31.2 | 9.1 | 2 | Yes | 830 | Yes | 600 | 335 | 2.9 | 156 |
| Inv. Ex. 3 | 1 | 0.014 | 0.11 | 0.51 | 31.2 | 9.1 | 2 | Yes | 1000 | Yes | 650 | 335 | 2.7 | 158 |
| Inv. Ex. 4 | 1 | 0.014 | 0.11 | 0.51 | 31.2 | 9.1 | 2 | Yes | 1200 | Yes | 600 | 341 | 2.6 | 148 |
| Inv. Ex. 5 | 1 | 0.014 | 0.11 | 0.51 | 31.2 | 9.1 | 3 | Yes | — | — | 600 | 326 | 3.1 | 142 |
| Inv. Ex. 6 | 2 | 0 | 0.36 | 0.53 | 30.4 | 10.7 | 3 | Yes | — | — | 700 | 318 | 3.5 | 138 |
| Inv. Ex. 7 | 3 | 0.023 | 0.47 | 0.37 | 31.1 | 10.2 | 2 | Yes | 1000 | Yes | 650 | 326 | 2.5 | 136 |
| Inv. Ex. 8 | 4 | 0.014 | 0 | 0.58 | 31.1 | 11.2 | 2 | Yes | 950 | Yes | 650 | 349 | 2.3 | 157 |
| Inv. Ex. 9 | 5 | 0.010 | 0.82 | 0.46 | 31.3 | 8.3 | 1 | Yes | 900 | — | — | 291 | 2.7 | 144 |
| Inv. Ex. 10 | 6 | 0.009 | 0.43 | 0 | 31.2 | 9.1 | 2 | Yes | 850 | Yes | 650 | 341 | 2.2 | 159 |
| Inv. Ex. 11 | 7 | 0.013 | 0.36 | 0.87 | 32.1 | 9.8 | 3 | Yes | — | — | 750 | 354 | 2.5 | 133 |
| Inv. Ex. 12 | 8 | 0.008 | 0.17 | 0.56 | 32.3 | 8.5 | 1 | Yes | 1100 | — | — | 334 | 2.3 | 160 |
| Inv. Ex. 13 | 9 | 0.013 | 0.19 | 0.47 | 30.0 | 12.3 | 2 | Yes | 900 | Yes | 650 | 334 | 3.4 | 141 |
| Inv. Ex. 14 | 10 | 0.012 | 0.09 | 0.25 | 32.1 | 8.2 | 2 | Yes | 1000 | Yes | 600 | 311 | 2.7 | 152 |
| Comp. Ex. 1 | 1 | 0.014 | 0.11 | 0.51 | 31.2 | 9.1 | 2 | Yes | 1300 | Yes | 700 | 346 | 2.4 | 118 |
| Comp. Ex. 2 | 1 | 0.014 | 0.11 | 0.51 | 31.2 | 9.1 | 2 | Yes | 1100 | Yes | 500 | 326 | 4.6 | 153 |
| Comp. Ex. 3 | 1 | 0.014 | 0.11 | 0.51 | 31.2 | 9.1 | 2 | Yes | 850 | Yes | 400 | 321 | 4.8 | 158 |
| Comp. Ex. 4 | 1 | 0.014 | 0.11 | 0.51 | 31.2 | 9.1 | 0 | — | — | — | — | 345 | 2.6 | 73 |
| Comp. Ex. 5 | 12 | 0.014 | 0.07 | 0.54 | 32.9 | 9.8 | 2 | Yes | 950 | Yes | 650 | 363 | 2.9 | 75 |
| Comp. Ex. 6 | 13 | 0.017 | 0.35 | 0.39 | 30.7 | 6.6 | 1 | Yes | 900 | — | — | 246 | 4.5 | 180 |
| Comp. Ex. 7 | 14 | 0.016 | 0.55 | 0.36 | 31.5 | 13.7 | 1 | Yes | 850 | — | — | 395 | 4.8 | 82 |

The invention claimed is:

1. A low thermal expansion cast steel having a chemical composition containing, by mass %, C: 0 to 0.100%, Si: 0 to 1.00%, Mn: 0 to 1.00%, Co: 8.3 to 13.0%, and Ni satisfying $-2.5\times\%\ Ni+85.5\leq\%\ Co\leq-2.5\times\%\ Ni+90.5$, wherein % Ni and % Co represent contents of Ni and Co in mass %, respectively, and having a balance of Fe and unavoidable impurities, having a 0.2% proof stress at a tensile test at 300° C. of 125 MPa or more, having an average coefficient of thermal expansion at 25 to 300° C. of 4.0 ppm/° C. or less, and having a Curie temperature of 250° C. or more.

2. A method for producing a low thermal expansion cast steel successively comprising a cryogenic treatment step of cooling a cast steel having a chemical composition of claim 1 from room temperature to an Ms point or less, holding the cast steel at a temperature of the Ms point or less for 0.5 to 3 hr, and raising the temperature up to room temperature and a recrystallization treatment step of heating the cast steel to 800 to 1200° C., holding the cast steel there for 0.5 to 5 hr, then quenching.

3. A method for producing a low thermal expansion cast steel successively comprising a first cryogenic treatment step of cooling a cast steel having a chemical composition of claim 1 from room temperature to an Ms point or less, holding the cast steel at a temperature of the Ms point or less for 0.5 to 3 hr, and raising the temperature up to room temperature, a recrystallization treatment step of heating the cast steel to 800 to 1200° C., holding the cast steel there for 0.5 to 5 hr, then quenching, a second cryogenic treatment step of cooling the cast steel from room temperature to the Ms point or less, holding the cast steel at a temperature of the Ms point or less for 0.5 to 3 hr, and raising the temperature up to room temperature, and a reverse transformation treatment step of heating the cast steel to 550 to 750° C., holding the cast steel there for 0.5 to 5 hr, then quenching.

4. A method for producing a low thermal expansion cast steel successively comprising a cryogenic treatment step of cooling a cast steel having a chemical composition of claim 1 from room temperature to an Ms point or less, holding the cast steel at a temperature of the Ms point or less for 0.5 to 3 hr, and raising the temperature up to room temperature and a reverse transformation treatment step of heating the cast steel to 550 to 750° C., holding the cast steel there for 0.5 to 5 hr, then quenching.

* * * * *